United States Patent [19]

Speed

[11] Patent Number: 4,639,954

[45] Date of Patent: Feb. 3, 1987

[54] MATERNITY BED

[75] Inventor: Philip Speed, Solihull, United Kingdom

[73] Assignee: Hoskins Limited, Birmingham, England

[21] Appl. No.: 632,952

[22] Filed: Jul. 20, 1984

[30] Foreign Application Priority Data

Oct. 1, 1983 [GB] United Kingdom ..... 8326357
Apr. 24, 1984 [GB] United Kingdom ..... 8410379

[51] Int. Cl.[4] ..... A61G 7/06

[52] U.S. Cl. ..... 5/63; 5/66; 5/69

[58] Field of Search ..... 5/60, 62–69, 5/308, 61, 11

[56] References Cited

U.S. PATENT DOCUMENTS

| | | | |
|---|---|---|---|
| 1,038,623 | 9/1912 | Merchant | 5/60 |
| 2,120,732 | 6/1938 | Comper . | |
| 2,257,491 | 9/1941 | Armstrong | 5/62 |
| 4,139,917 | 2/1979 | Fenwick . | |
| 4,247,091 | 1/1981 | Glowacki et al. | 5/66 |
| 4,270,233 | 6/1981 | Mulligan . | |
| 4,365,578 | 11/1982 | Clark | 5/66 |
| 4,411,035 | 10/1983 | Fenwick | 5/68 |
| 4,449,262 | 5/1984 | Jahsman et al. | 5/11 |

FOREIGN PATENT DOCUMENTS

| | | | |
|---|---|---|---|
| 1319593 | 6/1973 | United Kingdom | 5/63 |

*Primary Examiner*—Gary L. Smith
*Assistant Examiner*—Michael F. Trettel
*Attorney, Agent, or Firm*—Pearne, Gordon, McCoy, & Granger

[57] ABSTRACT

A maternity bed comprising a mattress main frame having a foot end and a head end, a base frame, a jacking means to support the main frame on the base frame and to permit of the height of the main frame relative to the base frame being varied, a mattress sub-frame movably mounted on the main frame for movement towards and away from the foot end of the main frame, the sub-frame comprising a base part supporting a mattress intermediate portion, and a backrest part supporting a mattress head portion and which is adjustable between a flat position in which the top surfaces of the mattress intermediate and head portions lie in a common plane, and an upright position in which the mattress head portion is inclined upwardly relative to the mattress intermediate portion at a maximum permitted angle, the main frame having means to support a mattress foot portion at the foot end of the main mattress frame when the sub-frame is at the head end of its permitted movement, the mattress foot portion being movable away from the foot end of the main frame to permit of the sub-frame being moved towards the foot end of the main frame, the base part of the sub-frame and mattress intermediate portion being formed to provide open-mouthed recess facing towards the foot end of the main frame, and the main frame having an open-mouthed recess at and facing outwardly away from, the foot end of the main frame, to permit of access to the perineal region of the mother.

11 Claims, 12 Drawing Figures

MATERNITY BED

BACKGROUND OF THE INVENTION

This invention relates to beds, and more particularly to beds for perinatal use, hereinafter referred to as maternity beds.

An object of the invention is to provide a maternity bed which not only enables a mother to select a position, from a wide range of positions, and to change her position, as desired during both labour and birth, but is also convenient for obstetric procedures.

SUMMARY OF THE INVENTION

According to the invention, we provide a maternity bed comprising a mattress main frame having a foot end and a head end, a base frame, a jacking means to support the main frame on the base frame and to permit of the height of the main frame relative to the base frame being varied, a mattress sub-frame movably mounted on the main frame for movement towards and away from the foot end of the main frame, the sub-frame comprising a base part supporting a mattress intermediate portion, and a backrest part supporting a mattress head portion and which is adjustable between a flat position in which the top surfaces of the mattress intermediate and head portions lie in a common plane, and an upright position in which the mattress head portion is inclined upwardly relative to the mattress intermediate portion at a maximum permitted angle, the main frame having means to support a mattress foot portion at the foot end of the main mattress frame when the sub-frame is at the head end of its permitted movement, the mattress foot portion being movable away from the foot end of the main frame to permit of the sub-frame being moved towards the foot end of the main frame, the base part of the sub-frame and mattress intermediate portion being formed to provide open-mouthed recesses facing towards the foot end of the main frame, and the main frame having an openmouthed recess at and facing outwardly away from, the foot end of the main frame, to permit of access to the perineal region of the mother.

The main frame preferably has an open mouthed recess at and facing outwardly away from, the head end of the main frame, to permit of access to the head of the mother when the mattress sub-frame is at or adjacent the foot end of its permitted movement relative to the main frame.

Accordingly an anaesthetist, for example, can conveniently gain access to the nose and/or mouth of the mother since he can position himself at least partly within the recess at the head end of the main frame.

The main frame may have a pair of laterally spaced support portions defining the sides of said recess at the foot end thereof, the support portions supporting a mattress base member which is movable to provide access to the recess at the foot end of the main frame.

The support portions may comprise a pair of spaced parallel side members of a generally rectangular main frame at the foot end thereof.

The mattress base member may be movably mounted on the main frame for movement between an operative position in which it is disposed at the foot end of the main frame and supports the mattress foot portion thereat, and an inoperative position in which the base member is displaced from the foot end towards the head end and permits of access to said recess at the foot end of the main frame.

The back part of the sub-frame may be movable to and maintainable in a desired one of a plurality of inclined positions between said flat and upright positions.

The back part may be provided with a ratchet strut mechanism to enable movement to maintenance in said desired positions.

The jacking means may comprise an X-linkage interconnecting said base and main frames, at least one of the four ends of the linkage being slidably connected to its associated frame for movement in a direction generally parallel to the plane of the associated frame.

The members of the X-linkage may be pivotally interconnected intermediate their ends and two of the four ends of the X-linkage may be slidably connected to their associated frames.

The members may be pivotally interconnected by means of an intermediate member pivotally connected to one member at a first position, and pivotally connected to the other member at a second position spaced from the first position, and the intermediate member being locatable relative to said one member in a desired angular orientation about said first position of connection whereby to permit of variation in the angular orientation of the mattress frame relative to the base frame to provide a head-up or head-down tilt facility.

The intermediate member may be locatable relative to the one member by means of a locating mechanism connected between the one member and the intermediate member at a third location spaced from the first and second locations.

The locating mechanism may comprise a pawl and ratchet mechanism.

The jacking means may include a jacking device arranged to act on one member of the X-linkage through a link pivoted to said one member and to the jacking device.

The jacking device may comprise fluid operated ram means.

Locating means may be provided to locate the sub-frame in a desired position along the main frame.

The sub-frame may be provided with means to receive and support lithotomy poles, hand grips and foot rests at the foot end of the sub-frame.

The main frame may be provided with means to receive and support foot rests and lithotomy poles at the foot end of the main frame.

The base frame may be provided with foot rest means at the foot end thereof for use by the mother when sitting on the mattress intermediate portion at or towards the foot end of the main frame.

The foot rest means may be provided with an open-mouthed recess facing outwards away from the foot end of the base frame to provide for access by a person to the perineal region of the mother.

The base frame may be provided with means to support a waste container at the foot end of the main frame.

The base frame may be provided with means to stow lithotomy poles, waste container or the like when not in use.

The three mattress portions may be removable from the main frame and sub-frame and hence used on the floor to permit the mother to stand or adopt some other position on the floor, or stored at the head end of the bed after the sub-frame has been positioned at the foot end.

The mattress portions may be made of a relatively soft construction.

The foot end of the mattress frame may be disposed substantially directly above the foot end of the base frame, whilst the head end of the main frame may extend outwardly substantially beyond the head end of the base frame.

The head end of the base frame may not project longitudinally outwardly beyond the headmost transversely extending member of the base frame.

A maternity bed embodying the present invention permits of a mother to adopt any one of a wide range of positions during labour and/or birth as well as permitting of access to the perineal region of the mother for obstetric procedures. In addition, the bed may be used for caesarian section or other surgical opoerations and, may be used in other hospital applications.

The positions which the mother may adopt include a flat lying position, a semi-reclining position, a sitting or semi-sitting position, a lithotomy position, a kneeling position with the forearms supported at a position above the hips and a kneeling position with the forearms supported at a position below the hips.

The bed also permits of a mother to be easily transferred between the above positions and in particular to be moved longitudinally of the bed so as to permit access to be gained to the perineal region whether the mother be in a fully reclining, semi-reclining, semi-sitting or fully sitting position, without requiring the mother to move her position of support by the intermediate mattress portion.

Moreover, access can easily be gained to the head of the mother in all of the positions by, for example, an anaesthetist.

BRIEF DESCRIPTION OF THE DRAWINGS

The invention will now be described in more detail by way of example, with reference to the accompanying drawings wherein.

DESCRIPTION OF THE PREFERRED EMBODIMENT

Figure 1:
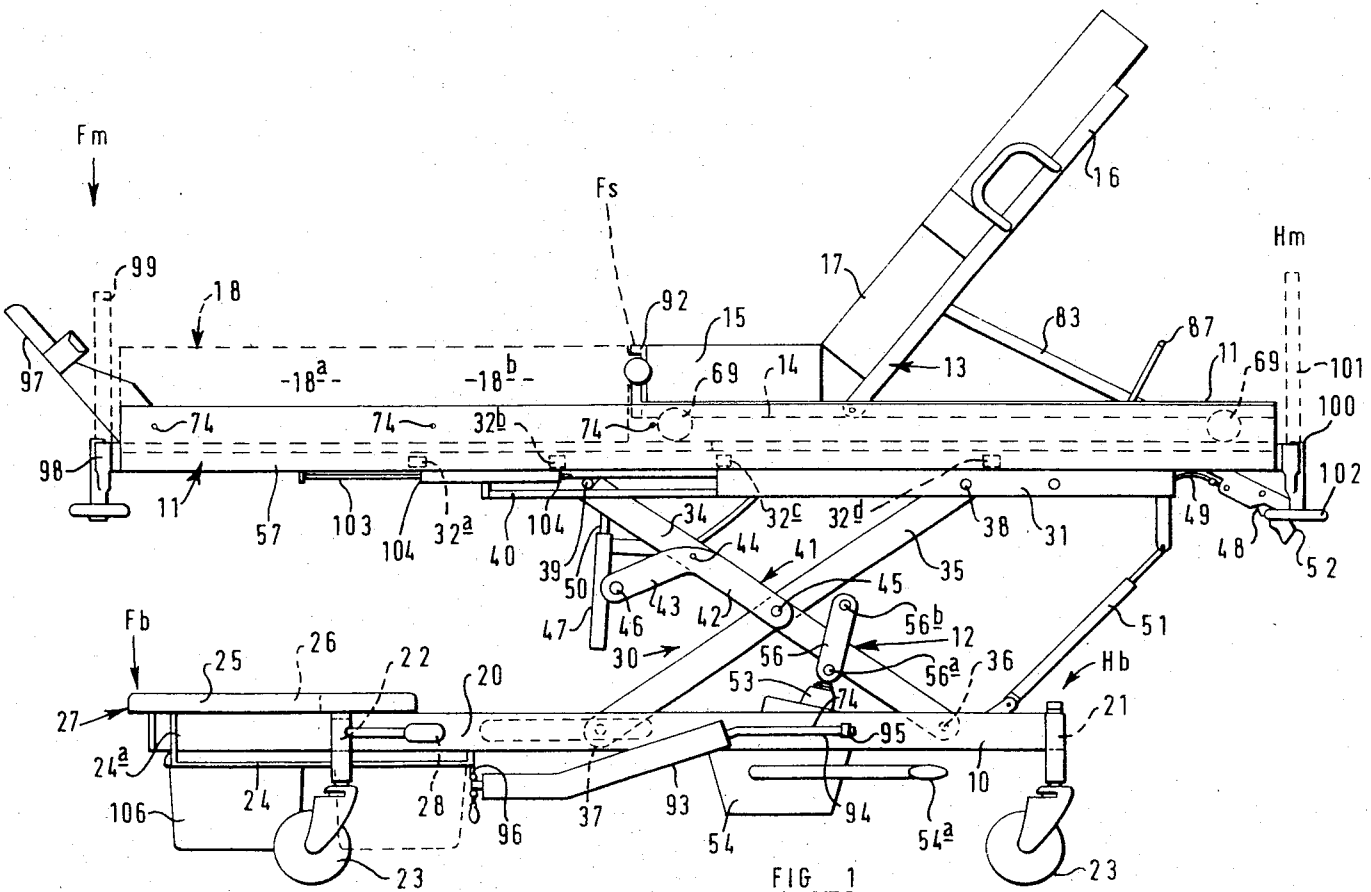
FIG. 1 is a side elevation of a maternity bed embodying the invention.
Figure 2:
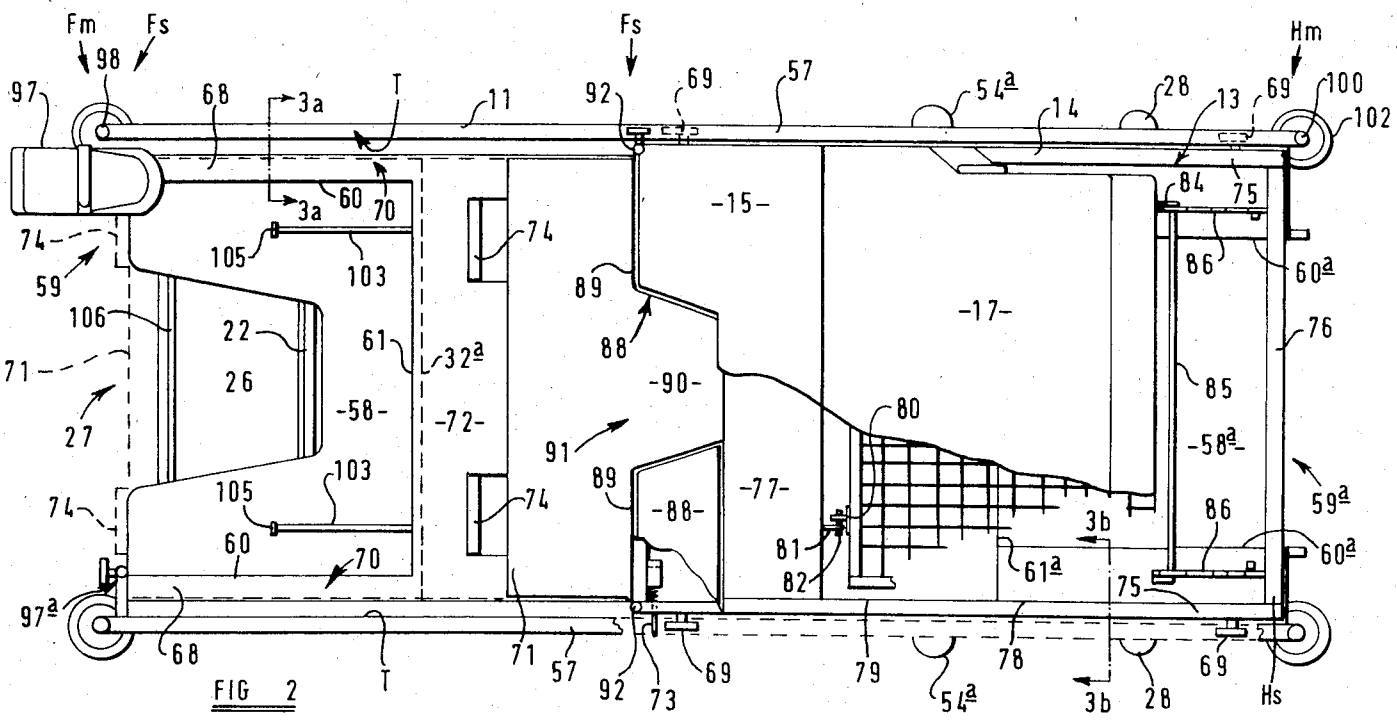
FIG. 2 is a plan view of the bed of FIG. 1.

Referring now to FIGS. 1 to 3, a maternity bed comprises a base frame 10 on which a mattress main frame 11 is supported by a jacking means 12. Movably mounted on the main frame 11 is a mattress sub-frame 13 which comprises a base part 14, supporting a mattress intermediate portion 15, and a backrest part 16, supporting a mattress head portion 17 pivotally connected to the portion 15. The main frame 11 also supports a mattress foot portion 18 which is separate from the interconnected head and intermediate portions but which is made in two pivotally interconnected parts 18*a*, 18*b* for convenience of handling and is shown in dotted line in FIG. 2.

The base frame 10 is rectangular comprising spaced parallel side members 20 interconnected at the head and foot ends $H_b$, $F_b$ of the base frame by transversely extending members 21, 22 respectively. At the corners of the thus formed rectangular base frame 10 are provided castors 23. At the foot end of the frame the side members continue longitudinally outwardly of the transversely extending member 22, and carry a footrest means 25 which is formed as a platform supported on the members 20, the transversely extending member 22 and is provided with a recess 26 which has an open mouth 27 facing outwardly away from the foot end $F_b$ of the base frame 10.

The castors 23 are provided with a conventional brake mechanism operable by a brake pedal 28 positioned on each side of the bed at the foot end $F_b$ of the base frame in conventional manner. The brake mechanism brakes both castor wheels on one side of the bed by means of connecting linkages, one extending transversely of the bed between the pedals and the other extending longitudinally of the bed between the castors on one side.

A jacking means comprising an X-linkage indicated generally at 30 is connected between the base frame 10 and the mattress main frame 11.

The X-linkage 30 comprises two members 34, 35 each comprising a pair of transversely spaced parallel tubes of rectangular cross-section which are interconnected by transverse members. The lower end of the member 34 is pivotally connected, as indicated at 36 to the side members 20 of the base frame 10, whilst the lower end of the member 35 is pivotally and slidably connected to the side members 20 as indicated at 37. The upper end of the member 35 is pivotally connected, as indicated at 38, to transversely spaced parallel intermediate members 31 secured to the underside of transversely extending members 32*a*–*d* of the main frame 11. The upper end of the member 34 is pivotally and slidably connected to the intermediate members 31 by means of a pivot pin 39 pivotally and slidably mounted in a slot 40 formed at the foot end of each intermediate member 31.

A jacking device comprising a hydraulic ram 53, to which fluid is pumped by a pump 54, operated by a foot pedal 54*a*, is connected between the base frame 10 and the member 34 by means of a link 56 pivotally connected to the ram 53 at 56*a* and to a lug (not shown) fixed to the link 34 at 56*b*. Repeated depression of the foot pedal 56 causes extension of the ram to cause extension of the X-linkage, whilst depression of the foot pedal 54*a* beyond a normal pumping position opens a valve to permit fluid to escape from the interior of the ram 53 and hence permits of collapse of the X-linkage. Thus the mattress main frame 11 may be raised and lowered relative to the base frame 10. If desired, alternatively, a mechanical jacking device may be provided such as a screw jack.

An intermediate member 41 in the form of a bell crank lever having arms 42, 43 is pivotally connected to the member 34 at 44, and to the member 35 at 45. The arm 43 of the member 41 is pivotally connected at 46 to a tube 47 which carries a spring loaded pawl (not shown) releasable by means of a manually engageable trigger 48 at the head end of the main frame $H_m$ through a cable 49. The pawl (not shown) is engageable with ratchet teeth provided on a rod 50 slidable within the tube 47 and connected at its upper end to the member 34.

Thus, by lifting or lowering the head end of the bed using hand grips 52, with one of which the trigger 48 is associated, the main frame 11 can be tilted into a head-up or head-down position relative to the horizontal and hence to the base frame 10 by virtue of rotation of the lever 41 about the pivot 44 relative to the member 34 permitted by sliding movement of the rod 50 into and out of the tube 47 when the ratchet is released by the trigger 48. A gas spring 51 is provided to facilitate raising and lowering of the head end during such manual adjustment.

The main frame 11 further comprises spaced parallel longer side members 57 interconnected by the transverse members 32 and further intermediate transverse member 32*a*.

At the foot end $F_m$ and the head end $H_m$ respectively, the main frame is provided with a recess 58, 58*a* having an open mouth 59, 59*a* facing outwardly away from the foot end $F_m$ at the foot end and facing outwardly away from the head end $H_m$ at the head end respectively. Each recess 58, 58*a* has its sides defined by inwardly facing edges 60, 60*a* of end portions of the side members 57, whilst its inner end is provided by a transversely extending edge 61, 61*a* of a sheet member 72 hereinafter to be described.

Figure 3A:
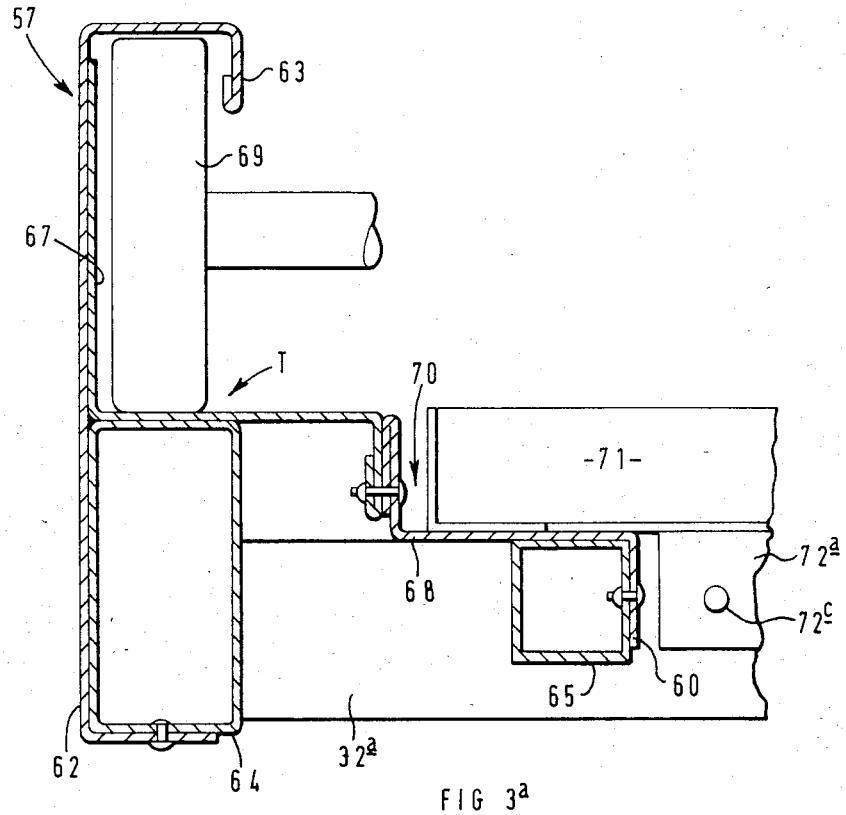
FIG. 3*a* is a diagrammatic cross-section on the line 3*a*—3*a* of FIG. 2.
Figure 3B:
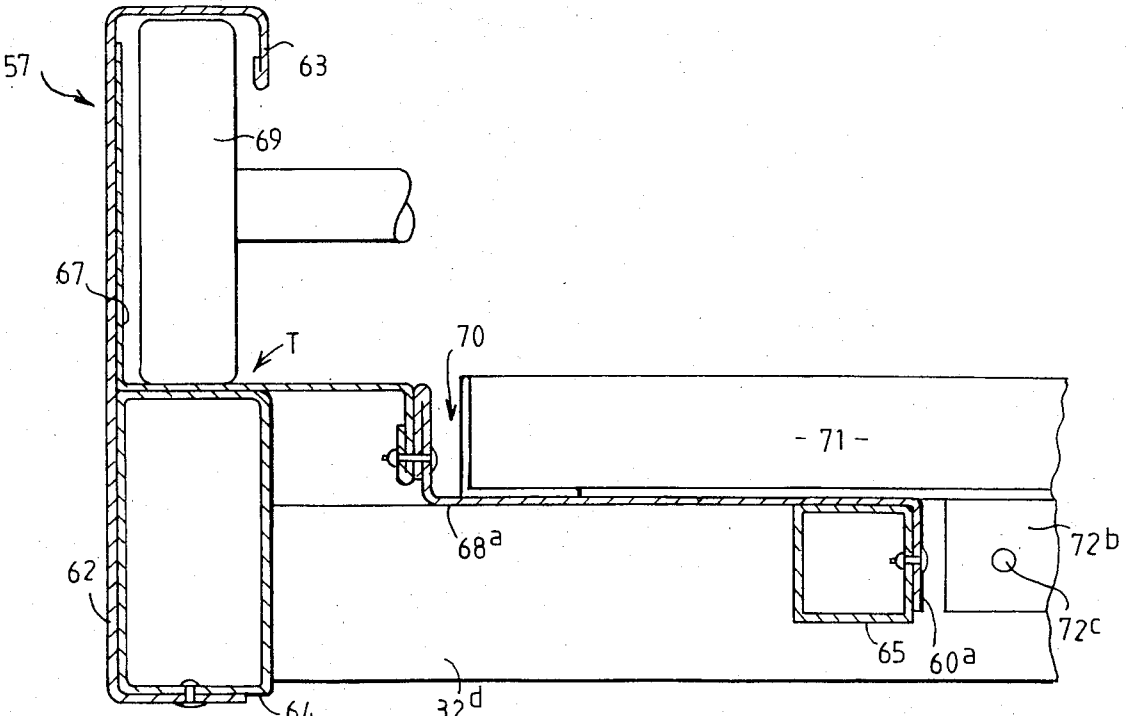
FIG. 3*b* is a diagrammatic cross-section on the line 3*b*—3*b* of FIG. 2.

The side members 57 are of fabricated construction illustrated diagrammatically in cross-section in FIGS. 3*a* and 3*b*.

Each member 57 comprises a channel section member 62 having a downturned flange 63 at its upper end. Rivetted to the lower limb of the member 62 is a rectangular section tube 64 which has welded to it the transverse members 32*a* to 32*d*. Welded to the transverse members 32*a* are square cross-section tubes 65. A Z-section member 67 is welded to the member 62. A Z-section member 68 at the foot end and a wider Z-section member 68 at the head end is rivetted to the member 67 and welded to the transverse members 32*a*, 32*d* respectively. The members 57 thus provide a track T for wheels 69 rotatably mounted on the base part 14 of the sub-frame 13, and a shoulder 70 for a mattress base member in the form of a drawer 71. Between the members 32a and 32d a metal sheet member 72 extends across the full width of the main frame beneath the drawer 71. The sheet 72 has downturned lips 72*a*, 72*b* which are rivetted to the members 32*a*, 32*d* respectively by rivets 72*c*.

Thus track T permits of the sub-frame 13 being moved between the foot and head ends of the main frame.

A pair of spring loaded catch pins 73 are provided and can be engaged in a desired one of a plurality of apertures 74 provided in the side members 57 of the main frame to enable the sub-frame to be locked in a desired position. In the present example, three apertures 74 are provided, the headmost aperture being used to lock the sub-frame in its headmost position, the footmost aperture 65 being used to lock the sub-frame 13 in its footmost position and the intermediate apertures 74 being used to lock the sub-frame in an intermediate position.

The drawer 71 is slidable on the shoulders 70 between an extended position, shown in dotted line in FIG. 2 in which it serves to support the foot mattress portion 18, and a retracted position, shown in full line in FIG. 2, in which access is permitted to the recess 58 and, of course to the recess 26. Hand grip portions 74 are provided to facilitate movement of the drawer 71.

The sub-frame 13 comprises a pair of spaced longer side members 75 interconnected by a transversely extending end member 76 at the head end $H_s$ of the sub-frame, and a transversely extending intermediate member 77. The members 75–77 comprise the base part 14 of the sub-frame and the backrest part 16 comprises a rectangular frame 78 carrying a weld mesh grid 79 and pivotally connected to the base part by means of lugs 80, 81 provided on the backrest and base part resepctively and which are pivotally interconnected by a pivot pin 82.

The backrest part 16 is maintainable in a desired inclined position by means of a stay 83 comprising a pair of spaced parallel elements 84 interconnected at their lower ends by a transverse rod 85 which is engageable with ratchet teeth 86 provided on the main part of the sub-frame 13 whereby the stay 84 can be engaged with desired ratchet teeth by manual grasping of handle 87 and adjustment of the stay to the desired position.

The head mattress portion 17 is supported on the backrest part 16 whilst the intermediate mattress portion 15 is supported on the base part of the sub-frame provided by the relatively wide transverse member 77 and platforms 88 provided with a retaining flange 89, and which define between them a recess 90 having an open mouth 91 facing outwardly away from the foot end $F_s$ of the sub-frame. The mattress intermediate portion has a recess 90*a* having an open mouth 91*a* corresponding to the recess 90, which interfits with a projection on the mattress foot portion 18.

The base part of the sub-frame 13 is provided with sockets 92 to receive conventional lithotomy poles which are shown in a stowed position at 93, in which an end portion 94 to be received in a socket 92 is received in a socket 95 provided on the side members of the base member 10, whilst the other end is supported by means of a hook 96 engageable with the strap of the lithotomy pole.

At the foot end $F_m$ of the main frame, removable foot rests 97 are provided which are received in sockets 97*a*.

Sockets 98 are provided at the foot end $F_m$ for a removable foot board 99. Similarly at the head end, sockets 100 are provided for a removable headboard 101. Wheel buffers 102 are provided at the four corners of the mattress main frame.

If desired, the lithotomy poles may be received in the socket 97*a* and the footrests in the sockets 92. Also, hand grips (not shown) may be received in either the socket 92 or the socket 97*a*.

Bowl support rods 103 are slidably mounted in a tube 104 provided on the transverse members 32, 32*a* and are movable between an extended position shown in FIG. 2, and a retracted position in which their headed ends 105 are in alignment with the edge 61.

A waste bowl 106 is supportable on the rods 103 by resting a peripheral lip of the waste bowl on the rods, or may be stowed on rods 24 underneath the footrest portion 25, or may be removed when access is required to the recess 26.

Figure 4:
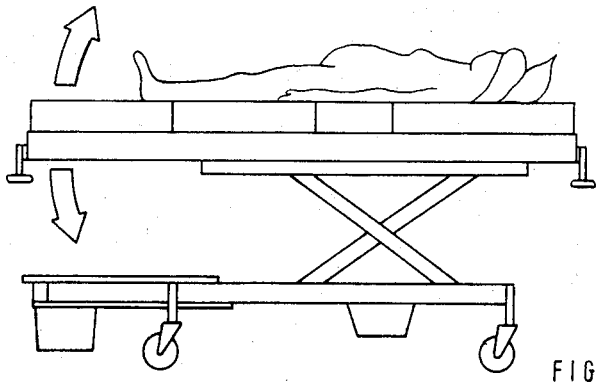
FIGS. 4 to 11 are diagrammatic illustrations showing alternative positions which a mother may adopt using the bed described with reference to FIGS. 1 to 3.

In use, the bed permits a mother to adopt a desired one of a wide range of possible positions, some of which are illustrated in FIGS. 4 to 9. For example, FIG. 4 illustrates a prone lying position, and as indicated the height of the mother can be adjusted by operation of the jacking mechanism 12.

Figure 5:
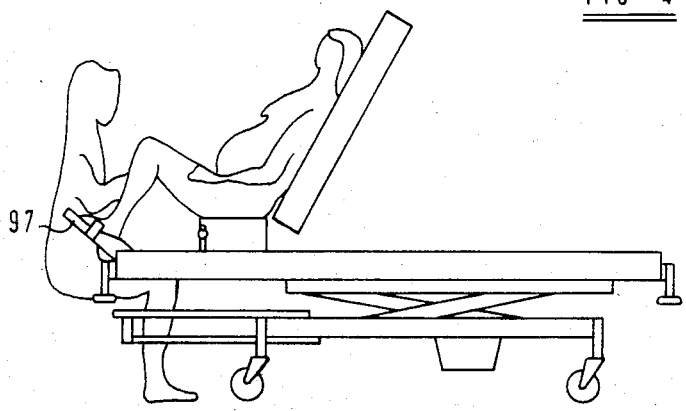

If desired, the mother can adopt a reclined sitting position, as shown in FIG. 5, in which her feet are supported by the foot rests 97 and her back by the head mattress portion 17 which is maintained in an inclined position by the strut 83. With the mother in this position, access is conveniently gainable to the perineal region by, for example a nurse or obstretician by virtue of the hereinbefore described recesses 26, 58 and 90 at the foot end.

Figure 6:
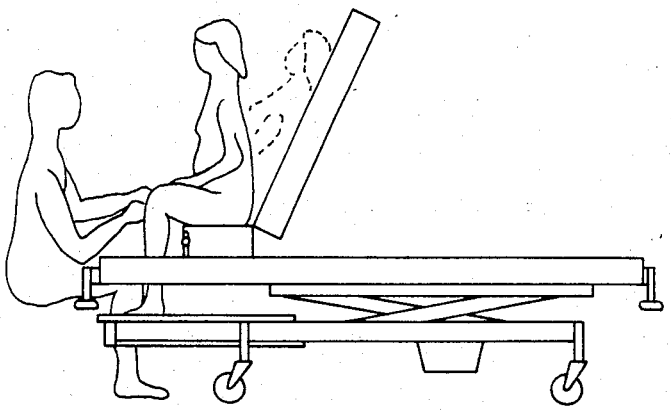

FIG. 6 illustrates a upright sitting position in which the mother's feet are supported by the footrest portion 25 but access is again conveniently gainable by virtue of the above mentioned recesses 26, 58 and 90 and, if desired, the mother may recline as indicated in dotted outline in FIG. 6.

Figure 7:
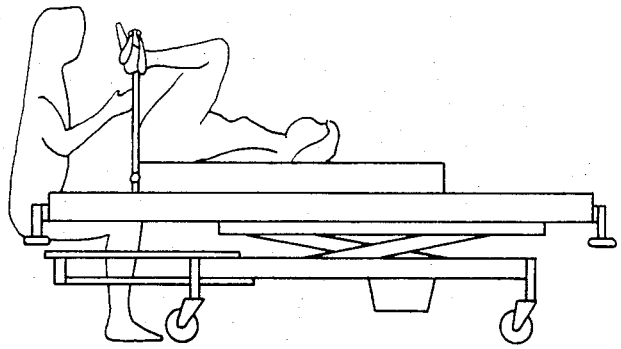

FIG. 7 illustrates the mother in a lithotomy position in which her feet are supported by lithotomy poles, and in all the positions illustrated in FIGS. 5, 6 and 7 the sub-frame is locked in its intermediate position and access is conveniently provided for personnel by the above described recesses.

Figure 8:
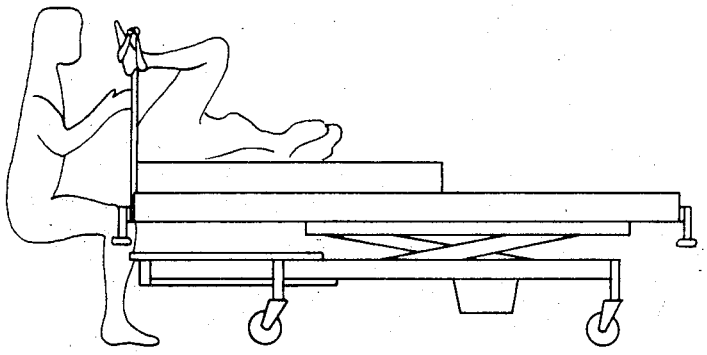

If desired, the sub-frame may be moved to its foot-most position as illustrated in FIG. 8, if the personnel find this more convenient.

Figure 9:
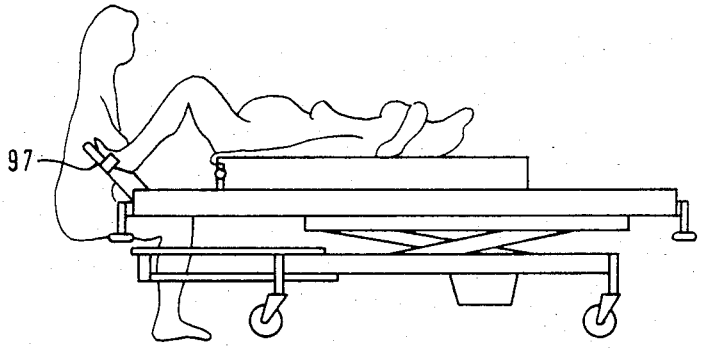

FIG. 9 illustrates the mother in a prone lying position with her feet supported by the foot rests 97 but in a convenient position for delivery in that the mattress is lowered to a height convenient for the obstretician or midwife, whilst access is conveniently gained to the perineal region of the mother by virtue of the above described recesses 26, 58 and 90 at the foot end.

Figure 10:
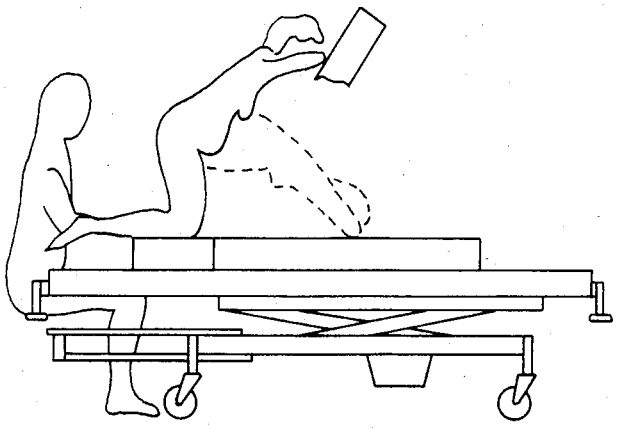

It will be appreciated that the mother can adopt other positions than those previously described, for example she can adopt either of the kneeling positions illustrated in FIG. 10, and again access is conveniently gained by providing the recesses.

Figure 11:
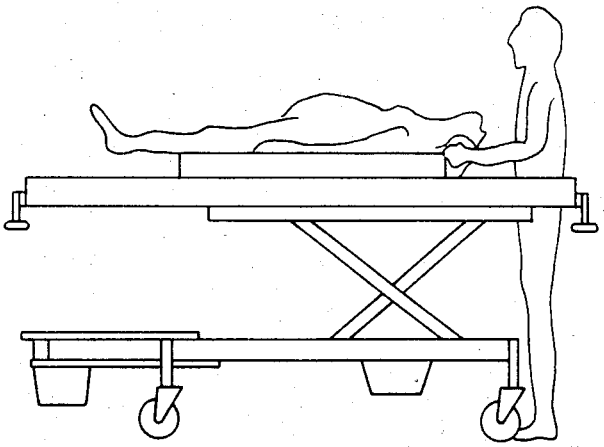

FIG. 11 illustrates how an anaesthetist can gain access to the mother's head, even when the sub-frame is at the foot end of its permitted travel relative to the main frame, by standing within the recess 58*a* at the head end $H_m$.

I claim:

1. A maternity bed comprising a mattress main frame extending longitudinally between a foot end and a head end, a base frame extending longitudinally between a foot end and a head end, a jacking means to support the main frame on the base frame and to permit of the height of the main frame relative to the base frame being varied, a mattress sub-frame movably mounted on the main frame for movement longitudinally of the main frame towards and away from the foot end of the main frame, the sub-frame comprising a base part having a foot end and a head end supporting a mattress intermediate portion having a foot end and a head end, and a backrest part supporting a mattress head portion and which is adjustable relative to the base part between a flat position in which the top surfaces of the mattress intermediate and head portions lie in a common plane, and an upright position in which the mattress head portion is inclined upwardly relative to the mattress intermediate portion at a maximum permitted angle, the main frame having means to support a mattress foot portion at the foot end of the main frame when the sub-frame is at the head end of its permitted movement, the mattress foot portion being movable away from the foot end of the main frame to permit of the sub-frame being moved towards the foot end of the main frame, the base part of the sub-frame and mattress intermediate portion each having an open-mouthed recess extending inward from the respective foot end towards the respective head end and each recess facing towards the foot end of the main frame, the main frame and the base frame each having a superposed open-mouthed recess extending inward from the respective foot end towards the respective head end and facing outwardly away from the respective foot end, to permit of access to the perineal region of the mother from below when the sub-frame is at the foot end of its permitted travel.

2. A bed according to claim 1 wherein the main frame has an open mouthed recess extending inward from the head end towards the foot end, and facing outwardly away from the head end, of the main frame, to permit of access to the head of the mother when the mattress sub-frame is at or adjacent the foot end of its permitted movement relative to the main frame.

3. A bed according to claim 1 or claim 2 wherein the main frame has a pair of laterally spaced support portions defining the sides of its respective recess at the foot end thereof, the support portions supporting a mattess base member which is movable to provide access to the recess extending inwardly from the foot end of the main frame.

4. A bed according to claim 3 wherein the mattress base member is movably mounted on the main frame for movement between an operative position in which it is disposed at the foot end of the main frame and supports the mattress foot portion thereat, and an inoperative position in which the base member is displaced from the foot end towards the head end and permits of access through said recess extending inward from the foot end of the main frame from below.

5. A bed according to claim 1 wherein the jacking means comprises an X-linkage interconnecting said base and main frames, at least one of the four ends of the linkage being slidably connected to its associated frame for movement in a direction generally parallel to the plane of the associated frame and a jacking device to act on one member of the X-linkage through a link pivoted to said one member and to the jacking device.

6. A bed according to claim 1 wherein the base frame is provided with means to support a waste container at the foot end of the main frame.

7. A bed according to claim 1 wherein the foot end of the mattress main frame is disposed substantially directly above the foot end of the base frame, whilst the head end of the main frame extends outwardly substantially beyond the head end of the base frame.

8. A bed according to Claim 1 wherein the head end of the base frame does not project longitudinally outwardly beyond the headmost transversely extending member of the base frame.

9. A maternity bed comprising a mattress main frame having a foot end and a head end, a base frame, a jacking means to support the main frame on the base frame and to permit of the height of the main frame relative to the base from being varied, the jacking means comprising an X-linkage interlocking said base and main frames, at least one of the four ends of the linkage being slidably connected to its associated frame for movement in a direction generally parallel to the plane of the associated frame and a jacking device to act on one member of the X-linkage through a link pivoted to said one member and to the jacking device, and the X-linkage comprising two members which are pivotally interconnected by means of an intermediate member pivotally connected to one member at a first position, and pivotally connected to the other member at a second position spaced from the first position, and the intermediate member being locatable relative to said one member in a desired angular orientation about said first position of connection whereby to permit of variation in the angular orientation of the mattress frame relative to the base frame to provide a head-up or head-down tilt facility, a mattress sub-frame movably mounted on the main frame for movement towards and away from the foot end of the main frame, the sub-frame comprising a base part supporting a mattress intermediate portion, and a backrest part supporting a mattress head portion and which is adjustable between a flat position in which the top surfaces of the mattress intermediate and head portions lie in a common plane, and an upright position in which the mattress head portion is inclined upwardly relative to the mattress intermediate portion at a maximum permitted angle, the main frame having means to support a mattress foot portion at the foot end of the main mattress frame when the sub-frame is at the head end of its permitted movement, the mattress foot portion being movable away from the foot end of the main frame to permit of the sub-frame being moved towards the foot end of the main frame, the base part of the sub-frame and mattress intermediate portion being formed to provide open-mouthed recesses facing towards the foot end of the main frame, and the main frame having an open-mouthed recess at and facing outwardly away from, the foot end of the main frame, to permit of access to the perineal region of the mother.

10. A maternity bed comprising a mattress main frame extending longitudinally between a foot end and a head end, a base frame extending longitudinally between a foot end and a head end, a jacking means to support the main frame on the base frame and to permit of the height of the main frame relative to the base frame being varied, a mattress sub-frame movably mounted on the main frame for movement longitudinally of the main frame towards and away from the foot end of the main frame, the sub-frame comprising a base part having a foot end and a head end supporting a mattress intermediate portion having a foot end and a head end, and a backrest part supporting a mattress head portion and which is adjustable relative to the base part between a flat position in which the top surfaces of the mattress intermediate and head portions lie in a common plane, and an upright position in which the mattress head portion is inclined upwardly relative to the mattress intermediate portion at a maximum permitted angle, the main frame having means to support a mattress foot portion at the foot end of the main frame when the sub-frame is at the head end of its permitted movement, the mattress foot portion being movable away from the foot end of the main frame to permit of the sub-frame being moved towards the foot end of the main frame, the base part of the sub-frame and mattress intermediate portion each having an open-mouthed recess extending inward from the respective foot end towards the respective head end and each recess facing towards the foot end of the main frame, the main frame and base frame each having an openmouthed recess extending inward from the respective foot end towards the respective head end and each recess facing outwardly away from the the respective foot end, with the recess of the main frame superposing the recess of the base frame to permit of access to the perineal region of the mother.

11. A maternity bed comprising a mattress main frame extending longitudinally between a foot end and a head end, a base frame extending longitudinally between a foot end and a head end, a jacking means to support the main frame on the base frame and to permit of the height of the main frame relative to the base frame being varied, a mattress sub-frame movably mounted on the main frame for movement longitudinally of the main frame towards and away from the foot end of the main frame, the sub-frame comprising a base part having a foot end and a head end supporting a mattress intermediate portion having a foot end and a head end, and a backrest part supporting a mattress head portion and which is adjustable relative to the base part between a flat position in which the top surfaces of the mattress intermediate and head portions lie in a common plane, and an upright position in which the mattress head portion is inclined upwardly relative to the mattress intermediate portion at a maximum permitted angle, the main frame having means to support a mattress foot portion at the foot end of the main frame when the sub-frame is at the head end of its permitted movement, the mattress foot portion being movable away from the foot end of the main frame to permit of the sub-frame being moved towards the foot end of the main frame, the base part of the sub-frame and mattress intermediate portion each having an open-mouthed recess extending inward from the respective foot end towards the respective head end and each recess facing towards the foot end of the main frame, and the main frame having an open-mouthed recess extending inward from the foot end towards the head end and facing outwardly away from the foot end, of the main frame, to permit of access to the perineal region of the mother, the base frame having footrest means at the foot end thereof for use by the mother when sitting on the mattress intermediate portion at or towards the foot end of the main frame, the footrest means surrounding an open-mouthed recess of the base frame superposed by the recess of the main frame and similarly permitting of access to the perineal region of the mother.

* * * * *